US006699264B1

(12) United States Patent
Röhrig

(10) Patent No.: US 6,699,264 B1
(45) Date of Patent: Mar. 2, 2004

(54) TEAT AND PACIFIER PROVIDED WITH SUCH A TEAT

(75) Inventor: Peter W. Röhrig, Vienna (AT)

(73) Assignee: Bamed AG, Altendorf (CH)

( * ) Notice: Subject to any disclaimer, the term of this patent is extended or adjusted under 35 U.S.C. 154(b) by 216 days.

(21) Appl. No.: 10/018,926

(22) PCT Filed: Jun. 21, 2000

(86) PCT No.: PCT/AT00/00170

§ 371 (c)(1),
(2), (4) Date: Dec. 19, 2001

(87) PCT Pub. No.: WO01/00136

PCT Pub. Date: Jan. 4, 2001

(30) Foreign Application Priority Data

Jun. 24, 1999 (AT) ..... 1112/99

(51) Int. Cl.[7] ..... A61J 17/00
(52) U.S. Cl. ..... 606/234; 215/11.4
(58) Field of Search ..... 606/234, 235, 606/236; 215/11.4, 11.5, 11.1

(56) References Cited

U.S. PATENT DOCUMENTS

| | | | | |
|---|---|---|---|---|
| 3,825,014 A | | 7/1974 | Wroten | |
| 4,505,398 A | | 3/1985 | Kesselring | |
| 4,623,069 A | | 11/1986 | White | |
| 5,711,759 A | | 1/1998 | Smith et al. | |
| 6,041,950 A | * | 3/2000 | Soehnlein | 215/11.1 |
| 6,241,110 B1 | * | 6/2001 | Hakim | 215/11.1 |

FOREIGN PATENT DOCUMENTS

| | | |
|---|---|---|
| DE | 2837438 | 8/1978 |
| DE | 29517040 | 2/1996 |
| DE | 19701969 | 7/1998 |
| EP | 0757909 | 2/1997 |
| FR | 2302724 | 1/1976 |
| JP | 9056787 | 3/1997 |
| WO | WO9720502 | 6/1997 |

* cited by examiner

*Primary Examiner*—Kevin T. Truong
(74) *Attorney, Agent, or Firm*—Ladas & Parry

(57) ABSTRACT

A pacifier nipple (2) including a shaft member (3) with a fastening portion (4) to fix the nipple (2) to a pacifier shield (5), and a head member (6) which is located opposite the fastening portion (4) and wide relative to the shaft member (3), wherein the head member (6), on its external side, comprises at least one thickened region (7) forming at least one raised part (7'; **7*a*; 7*b*; 7*c*), and that at least one saliva flow channel (8) is provided in the thickened region (7**).

18 Claims, 3 Drawing Sheets

TEAT AND PACIFIER PROVIDED WITH SUCH A TEAT

BACKGROUND OF THE INVENTION

1. Field of the Invention

The invention relates to a pacifier nipple including a shaft member with a fastening portion to fix the nipple to a pacifier shield, and a head member which is located opposite the fastening portion and wide relative to the shaft member.

Furthermore, the invention relates to a pacifier comprising such a pacifier nipple.

2. Prior Art

ECC caries (early childhood caries) is the main type of caries affecting the first teeth of infants under the age of three. An infant may develop caries already at the age of seven months. Investigations have revealed that the use of bottle food promotes the growth of streptococcus and lactobacillus, both being organisms that are involved in the development of caries; yet, infants will exhibit lower overall numbers of bacteria and streptococci, if nipples that do not serve food ingestion, e.g., pacifier nipples are used for soothing. When ingesting food, e.g., milk or liquid pap, the food in the infant's mouth will act as a nutrient for organisms, thus promoting their growth and the formation of caries. By contrast, if an infant sucks a pacifier nipple, an elevated amount of saliva will collect in the infant's mouth, thus reducing the number of bacteria, streptococci, etc., and also reducing the risk of,caries formation.

However, due to the position of the salivary glands in the mouth, the gravity and the type of the saliva flow in the mouth of an infant, a relatively small amount of saliva reaches the infant's teeth according to investigations that have led to the present invention, so that bacteria colonies may exactly grow there relatively undisturbed, leading to ECC caries and, in particular, the baby bottle syndrome (tooth decay).

U.S. Pat. No. 5,275,619 A describes a pacifier comprising an externally smooth nipple, said nipple having a shaft member and a wider head member. Ribs are provided in the head member on its internal side to reinforce the nipple. That nipple (and comparable nipples according to the prior art) only poorly stimulates the production of saliva and, in particular, has the drawback of not ensuring a saliva flow towards the teeth.

DE 197 01 969 A1, in turn, discloses a nipple comprising a hollow-cylindrical shaft provided with nodules. Those nodules, on the one hand, are to promote the blood flow through the jaws and the support of tooth formation and, on the other hand, are to provide an alleviating effect during teething in the manner of a teething ring. This does neither result in the stimulation of saliva production nor in an (increased) saliva flow to the tooth region.

SUMMARY OF THE INVENTION

Thus, it is the object of the invention to provide a pacifier nipple of the initially defined kind, which stimulates intensive saliva production and ensures a saliva flow to the teeth in order to obtain an optimum mouth flora also in the tooth region.

The pacifier nipple according to the invention, of the initially defined kind is characterized in that the head member, on its external side, comprises at least one thickened region forming at least one raised part, and that at least one saliva flow channel is provided in the thickened region.

A pacifier nipple designed in this manner ensures that during sucking the thickened region provided on the external side of the head member, i.e. the at least one raised part, as a "saliva stimulating elevation" massages the interior of the mouth and, in particular, the region of the saliva glands so as to strongly stimulate the production of saliva. Yet, the saliva does not remain in the rear mouth region, but is conducted through the saliva flow channel(s) forwardly to the teeth, where its antibacterial action becomes fully effective, thus largely reducing the formation of caries. It is feasible to provide a single saliva flow channel, yet the more saliva flow channels are provided in the thickened region the more saliva will be conducted to the teeth, and accordingly several saliva flow channels are, thus, provided in a preferred manner.

It should be noted that a nipple comprising an external rib-shaped thickening is known from U.S. Pat. No. 3,946,888 A. Those ribs, however, serve to stiffen the nipple, apart from the fact that the nipple according to U.S. Pat. No. 3,946,888 A is a bottle nipple such that the saliva, through the ingestion of food via a drinking bottle, is additionally rinsed out of the mouth and the food constitutes a nutrient for organisms. EP 0 757 909 A1 likewise describes a bottle nipple comprising peripherally extending ribs externally on the shaft, which are to cause the simultaneous movement of the suction part during the exertion of a suction force in order to ensure the cleansing of the tongue surface from food remainders. From FR 2 302 724 A, a similar bottle nipple is known, which comprises a wavy external surface to enable the nipple to expand in the longitudinal direction as a suction force is being applied. Also U.S. Pat. No. 4,623,069 A describes a similar bottle nipple, which in that case is comprised of two walls slipped one into the other. Thus are formed two chambers which serve as flexible adaptation means, offering a twice reinforced resistance against the lateral pressure during suction and biting movements. Furthermore, DE 197 16 534 A1 shows a bottle nipple comprising elevations and/or depressions on at least one of its broad sides. Again, this is a bottle nipple which is intended to be kept within the mouth only for a while during drinking and exhibits the drawbacks described above. GB 2 463 A.D. 1873, moreover, discloses a teething plate which comprises elevations and depressions of different shapes. These serve to massage the palate, to provide an enhanced support within the infant's mouth and to grind off the teeth. That teething plate, however, does not enable a "mouthfilling" suction, since it is designed to be flat, thus hardly stimulating the production of saliva, nor is the saliva conducted to the teeth.

In order to ensure the optimum saliva flow to the infant's teeth with the instant pacifier nipple, it is, moreover, favorable if the saliva flow channel extends in the direction of the shaft member. In this case, saliva flow channels may extend towards the center of the fasting portion and also obliquely towards the two sides in order to ensure a saliva flow also towards the lateral teeth.

Furthermore, it is advantageous if at least one saliva flow channel extends linearly. Thus, the saliva is conducted to the teeth rapidly and directly.

Preferably, at least one saliva flow channel extends in a wave-shaped or zig-zag-like manner. Thereby, a wider region is each covered by a single saliva flow channel which is longer than a straight-line saliva flow channel, thus ensuring even more saliva to be collected in the saliva flow channel.

A particularly favorable embodiment is characterized in that at least two saliva flow channels extending in parallel are provided. These saliva flow channels may extend both linearly and in a wave-shaped or zig-zag-like manner. If several saliva flow channels extending in parallel are provided, a constant flow of saliva in the direction towards the teeth will be ensured, the saliva being conducted not only to the central front teeth, but to the entire front region of the teeth, from where the saliva may flow on laterally.

Furthermore, it is advantageous if at least two mutually intersecting saliva flow channels are provided. Such saliva flow channels may extend, for instance, obliquely to the longitudinal axis of the nipple such that, if several saliva flow channels are provided, these will form a cross-shaped pattern. In this manner, the saliva flow is distributed uniformly over the head member of the nipple so as to ensure that all the teeth will be reached by saliva.

In all these different embodiments of the saliva flow channels, also the cross section of the respective saliva flow channel may be designed in different ways. It may, for instance, be triangular, rectangular or polygonal or round. What is important is that the saliva flow channels are easy to clean, so that undercuts are to be avoided in any event. The maximum depth possible, of the saliva flow channel(s) depends also on the thickness of the thickened region, and the width of the saliva flow channel(s) as well as the width of the thickened region between two saliva flow channels may be designed differently.

It is favorable, if the, or at least one, raised part of the thickened region is designed to be rectangular and/or triangular and/or round in cross section. The different cross-sectional shapes of these raised parts, which form local elevations to stimulate saliva production, will influence the stimulation of the saliva glands differently. In addition, the use of a specific cross-sectional shape also is a function of the sensitivity of the infant's mouth, wherein, for instance, a triangular cross section may be used for a more insensitive mouth or a toddler's mouth, whereas a rounded cross section is to be preferred in the event of lesions, inflammations or other sensitive sites in the mouth, or for premature infants and babies, providing for a smoother massage.

An advantageous embodiment is characterized in that different saliva flow channel configurations are provided in the thickened regions of the head member. It is, for instance, feasible to provide linear, mutually crossing saliva flow channels in a thickened region of the head member and parallely extending, wave-shaped saliva flow channels in another thickened region.

Preferably, different thickened head member regions including raised parts with differently designed cross sections are provided. In this manner, one is free to insert the nipple into the infant's mouth upwardly in the direction towards the palate by one or the other side, by one or the other thickened region, so as to ensure different stimulations due to the different configurations of the two thickened regions, depending on the position of the nipple in the mouth. The production of saliva will be stimulated even more by such a variable stimulating effect.

Another favorable embodiment consists in that the thickness of the nipple between the bottom of each saliva flow channel and the internal surface of the nipple corresponds to the thickness between the internal and external surfaces of the nipple outside the thickened region. This embodiment offers simple manufacture, additionally ensuring an optimum wall thickness of the nipple, which may, one the one hand, be thick enough to guarantee a long service life of the nipple and an adequate depth of the saliva flow channels and, on the other hand, be thin enough to make the nipple altogether flexible to an appropriate extent.

Preferably, an elevation is provided in the vicinity of the saliva flow channel, on the end located opposite the fastening portion. This elevation stimulates the rear region of the palate to a particularly high degree, which will cause an increased saliva production.

Suitably, the pacifier nipple and/or the pacifier shield are designed in a manner that, with the pacifier in use, the raised parts of the thickened regions are located topside and/or bottomside within the mouth, thus rendering saliva production particularly efficient. This will be reached, for instance, if the pacifier shield is designed to be oval or lemniscate-shaped (cf., e.g., U.S. Pat. No. 5,403, 349 A) such that the pacifier—even with a nipple having a circular cross section—will be taken into the mouth with one or the other side always directed upwards, but never directed transverse, since the shield predefines the position of the nipple in the mouth.

A particularly favorable nipple is provided in that it has an oval cross section—as known per se. Thus, the position of the nipple in the mouth is predetermined by the shape of the nipple: The "flat" sides of the nipple forming the upper and lower sides of the nipple in the mouth. In this case, only one flat side may comprise at least one thickened region, yet a configuration comprising thickened regions on both flat sides of the nipple is more favorable. In this manner, the position of the nipple in the infant's mouth is not critical in terms of upper and lower sides, a strong flow of saliva towards the teeth being ensured at any time.

It is of advantage if a smooth edge zone surrounding the thickened region is provided. Enlargements in the edge zone, in particular with elliptical nipple cross sections will, in fact, not cause any intensification, but surprisingly facilitate the biting through of the nipple, as studies have demonstrated.

It is, of course, possible to impart elongate, round, stellar or any other shapes on the surface of the thickened region, whereby one of the regions of the head part again may have another thickened region surface shape than another region.

Preferably, the pacifier nipple is made of silicone, latex, rubber or synthetic materials. In terms of manufacture, it is easier to produce the whole pacifier including its enlargements of the same material, yet it is also feasible to make a nipple of one material and a thickened region in the form of a coat, of another material. The choice of the respective material also is a function of the desired thickness of the nipple, with health aspects having to be taken into account, anyway.

Furthermore, the invention provides a pacifier including a pacifier shield, which comprises a pacifier nipple as defined above. In this case, the nipple is attached inside the pacifier shield by its fastening portion in a conventional manner, for instance, by clamping, gluing, etc.

BRIEF DESCRIPTION OF THE DRAWINGS

In the following, the invention will be explained in more detail by way of preferred embodiments illustrated in the drawing, to which the invention is, however, not limited and wherein.

DETAILED DESCRIPTION OF PREFERRED EMBODIMENTS OF THE INVENTION

Figure 1A:
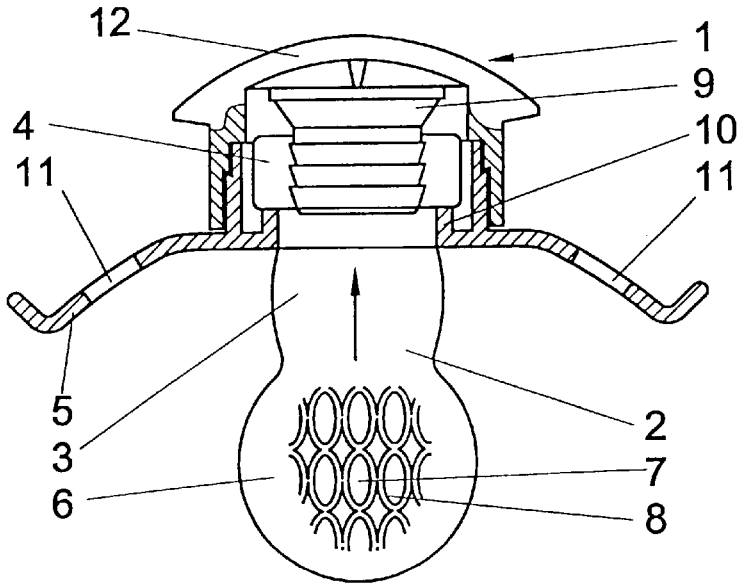
FIGS. 1A, 2A, 3A and 4A are each partially sectioned views of different structures of pacifiers comprising nipples.

FIG. 1A depicts a pacifier 1 comprising a nipple 2 that is elliptical in cross section and provided with structures, said nipple 2 including a shaft member 3 having a fastening portion 4 to fix the nipple 2 to a pacifier shield 5 of the pacifier 1, which may be, for instance, lemniscate-shaped or oval, and a wide head member 6 facing away from the fastening portion 4. On the two flatter sides of the head member 6 is provided a thickened region 7 which comprises saliva flow channels 8 (in the following briefly referred to as "flow channels") extending in a wave-shaped and mutually intersecting manner and defining individual raised parts 7' forming saliva stimulating elevations. The thickened regions 7 stimulate the production of saliva in the infant's mouth, the saliva being conducted through the flow channels 8 in the direction of the shaft 3 and the fastening portion 4 and hence towards the infant's teeth, cf. the arrow in FIG. 1A. The fastening portion 4 of the nipple 2 is clamped between a wedge 9 and the wall 10 of an opening of the pacifier shield 5. The pacifier shield 5, furthermore, includes apertures 11 which are to act as emergency respiration apertures and—being ventilation apertures—ensure better drying of the facial skin of the infant in the region of the mouth. In addition, a cap-shaped handle 12 is attached to the pacifier shield 5.

Figure 1B:
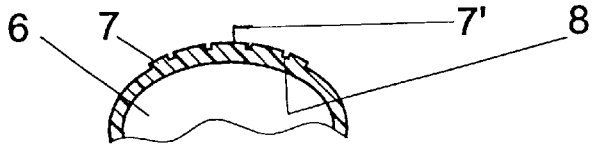
FIGS. 1B, 2B, 3B and 4B illustrate partial cross sections through the head members of the nipples of these pacifiers.

FIG. 1B illustrates the cross section of one half of the pacifier 2 represented in FIG. 1A, from which also the oval cross section of the nipple 2 is apparent. The raised portions 7' of the thickened regions have rectangular cross sections.

Figure 2A:
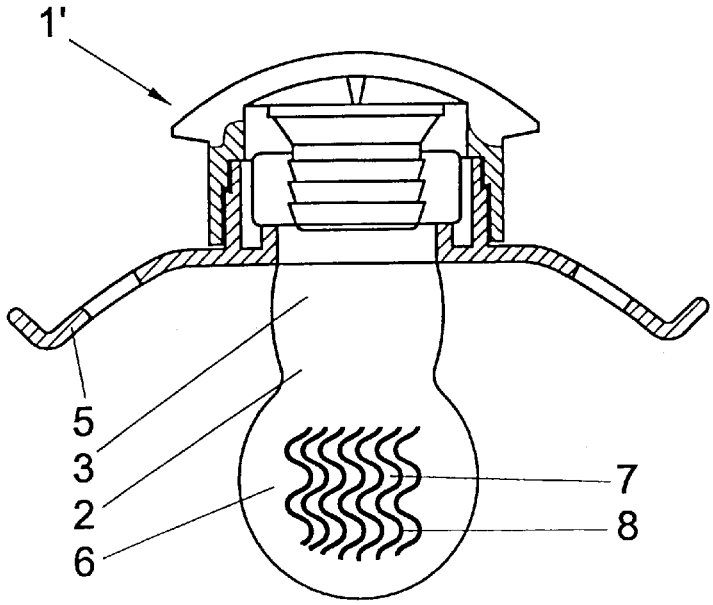
Figure 2B:
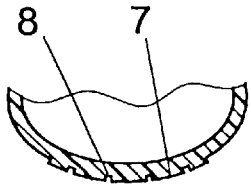

FIGS. 2A and 2B depict a pacifier 1' that is identical in terms of general structure, yet comprises a modified pacifier nipple 2, wherein the flow channels 8—although wave-shaped as in FIGS. 1A and 1B—are designed to extend parallel with one another. As in FIG. 1A, the thickened region 7 is provided in the central region of the head member 6, with the edge region being smooth, though. Biting through of the pacifier 2 will, thus, be prevented.

A pacifier configuration in which, for instance, one side of the pacifier nipple is designed in accordance with FIGS. 1A and 1B and the second side is designed in accordance with FIGS. 2A and 2B is also conceivable.

Figure 3A:
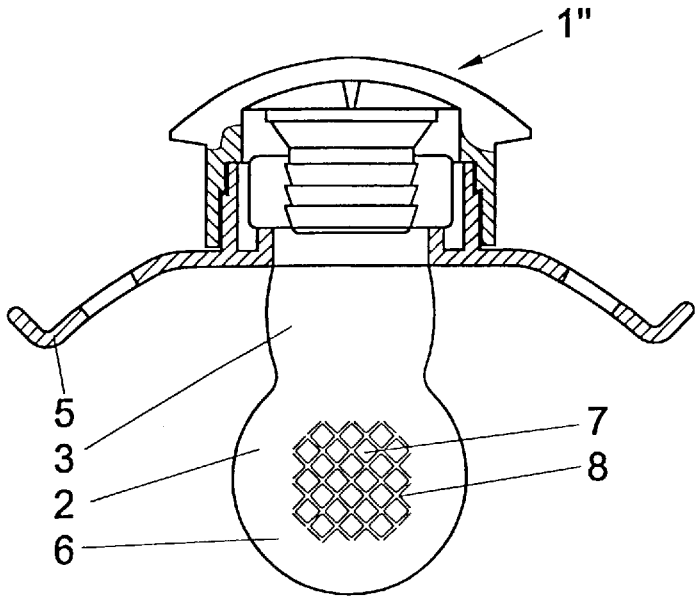
Figure 3B:
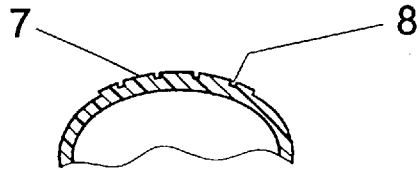
Figure 4A:
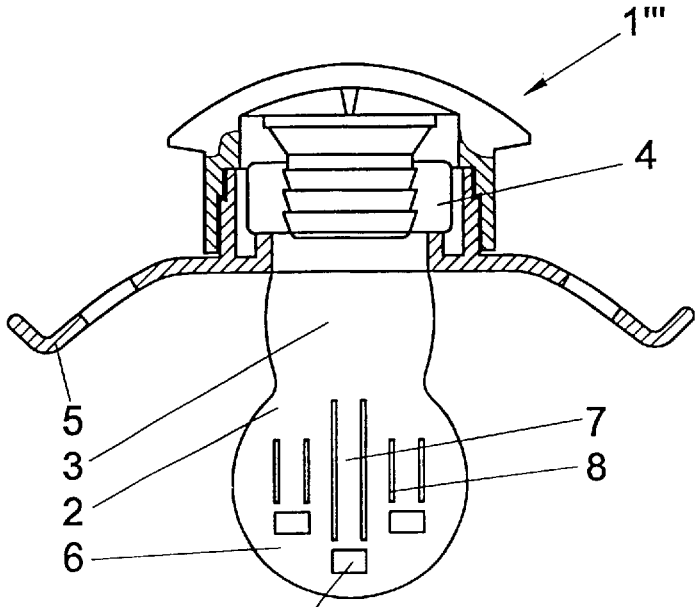
Figure 4B:
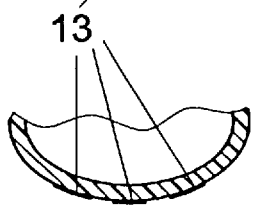

FIGS. 3A, 3B and FIGS. 4A, 4B represent further pacifiers 1" and 1'", respectively, comprising nipples 2 with thickened regions 7 and flow channels 8, FIG. 3A illustrating linear, mutually intersecting flow channels 8 and FIG. 4A illustrating linear flow channels 8 extending parallel with one another. From FIG. 4A it is, furthermore, apparent that additional elevations 13 are provided on the end of the flow channels 8, that is located opposite the shaft member 3, which elevations serve to specifically stimulate the rear palatal region of the baby's mouth, which will promote the production of saliva even more intensively. Again, FIGS. 3A and 3B may represent one side of a nipple 2 and the other side of the same nipple 2 may be configured in accordance with FIGS. 4A and 4B.

Any desired combinations of, e.g., the four nipple structures represented, or nipples 2 comprising one and the same structure on either side, or nipples 2 having but one structured side may be provided.

Figure 5A:
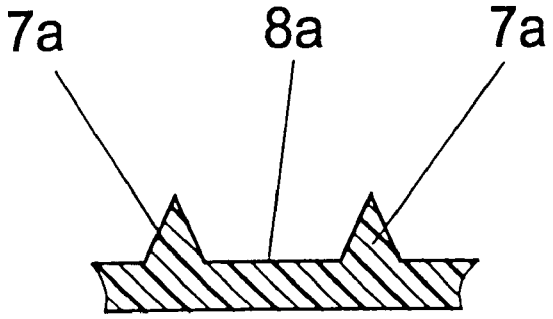
FIGS. 5A, 5B, 5C illustrate cross sections of different configurations of the raised parts of thickened regions and saliva flow channels.
Figure 5B:
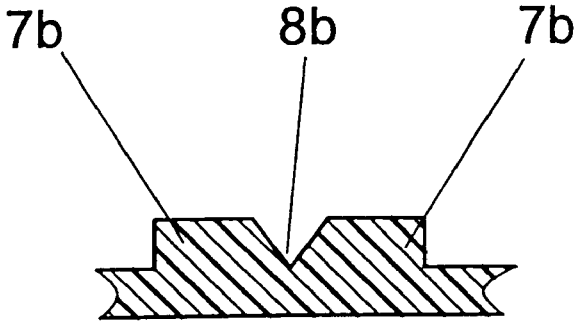
Figure 5C:
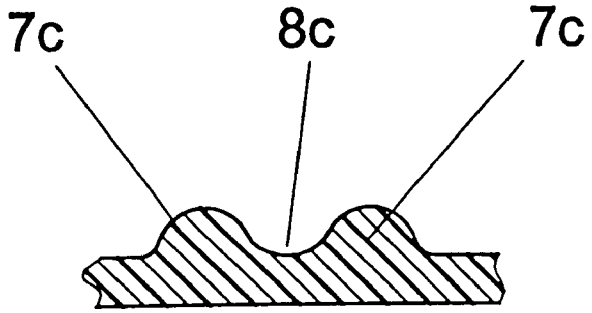

FIGS. 5A, 5B and 5C illustrate different raised parts 7*a*, 7*b*, 7*c* of the thickened regions 7 in cross section, the raised parts 7*a* according to FIG. 5A having triangular cross sections, the raised parts 7*b* according to FIG. 5B having rectangular, in particular trapezoidal, cross sections, and the raised parts 7*c* according to FIG. 5C having round cross sections. The flow channels 8*a* according to FIG. 5A are trapezoidal in cross section, the flow channels 8*b* according to FIG. 5B are triangular in cross section, and the flow channels 8*c* according to FIG. 5C are round in cross section. The flow channel 8*a* according to FIG. 5A is substantially wider than the flow channel 8*b* according to FIG. 5B or the flow channel 8*c* according to FIG. 5C.

The aforementioned embodiments are merely given as examples and it goes without saying that any other shapes of the raised parts and flow channels are feasible, e.g., flow channels 8 or raised parts 7' of the thickened regions 7 having rectangular cross sections.

What is claimed is:

1. In a pacifier nipple arrangement to be used with a pacifier having a pacifier shield and of the type including a shaft member having a fastening portion configured to fix said pacifier nipple to said pacifier shield and a head member located opposite said fastening portion, said head member being wide relative to said shaft member, the improvement comprising at least one thickened region provided on said head member on its external side and forming at least one raised part, at least one saliva flow channel means provided in said at least one thickened region, and wherein said head member of said pacifier nipple is hollowly designed.

2. A pacifier nipple as set forth in claim 1, wherein said at least one saliva flow channel means extends in the direction of said shaft member.

3. A pacifier nipple as set forth in claim 1, wherein said at least one saliva flow channel means extends linearly.

4. A pacifier nipple as set forth in claim 1, wherein said at least one saliva flow channel means extends in a wave-shaped manner.

5. A pacifier nipple as set forth in claim 1, wherein said at least one saliva flow channel means extends in a zig-zag-like manner.

6. A pacifier nipple as set forth in claim 1, wherein said at least one saliva flow channel means comprises at least two saliva flow channels extending in parallel.

7. A pacifier nipple as set forth in claim 1, wherein said at least one saliva flow channel means comprises at least two mutually intersecting saliva flow channels.

8. A pacifier nipple as set forth in claim 1, wherein said at least one raised part of said thickened region is designed to be rectangular in cross section.

9. A pacifier nipple as set forth in claim 1, wherein said at least one raised part of said thickened region is designed to be triangular in cross section.

10. A pacifier nipple as set forth in claim 1, wherein said at least one raised part of said thickened region is designed to be round in cross section.

11. A pacifier nipple as set forth in claim 1, wherein different saliva flow channel configurations are provided in different thickened regions of said head member.

12. A pacifier nipple as set forth in claim 1, wherein different thickened regions are provided with raised parts having different cross-sectional designs.

13. A pacifier nipple as set forth in claim 1, wherein said at least one saliva flow channel means has a channel bottom, said pacifier nipple has a nipple internal surface and a nipple external surface, a first thickness is provided between said channel bottom and said nipple internal surface and a second thickness is provided between said an nipple internal surface and said nipple external surface, said first thickness corresponding to said second thickness outside said thickened region.

14. A pacifier nipple as set forth in claim 1, further comprising an elevation provided in the vicinity of said saliva flow channel means, on its end located opposite said fastening portion.

15. A pacifier nipple as set forth in claim 1, further comprising a smooth edge zone surrounding said thickened region.

16. A pacifier nipple as set forth in claim 1, wherein said pacifier nipple has an oval cross section.

17. A pacifier nipple as set forth in claim 1, wherein said pacifier nipple is made of silicone, latex, rubber or a synthetic material.

18. A pacifier comprising a pacifier shield and a pacifier nipple including a shaft member having a fastening portion configured to fix said pacifier nipple to said pacifier shield and a head member located opposite said fastening portion, said head member being wide relative to said shaft member, and wherein at least one thickened region is provided on said head member on its external side so as to form at least one raised part, at least one saliva flow channel means is provided in said at least one thickened region, and said head member of said pacifier nipple is hollowly designed.

* * * * *